US008448463B2

(12) United States Patent
Prosser et al.

(10) Patent No.: US 8,448,463 B2
(45) Date of Patent: May 28, 2013

(54) CRYOGENIC RECTIFICATION METHOD

(75) Inventors: Neil Mark Prosser, Lockport, NY (US); Wei Zhang, Burlington (CA)

(73) Assignee: Praxair Technology, Inc., Danbury, CT (US)

( * ) Notice: Subject to any disclaimer, the term of this patent is extended or adjusted under 35 U.S.C. 154(b) by 1086 days.

(21) Appl. No.: 12/411,700

(22) Filed: Mar. 26, 2009

(65) Prior Publication Data

US 2010/0242538 A1 Sep. 30, 2010

(51) Int. Cl.
*F25J 3/00* (2006.01)

(52) U.S. Cl.
USPC ..... 62/646; 62/643; 62/905; 62/924

(58) Field of Classification Search
USPC ..... 62/640, 643, 646, 905, 924
See application file for complete search history.

(56) References Cited

U.S. PATENT DOCUMENTS

| | | | | |
|---|---|---|---|---|
| 3,688,513 A | | 9/1972 | Streich et al. | |
| 5,034,043 A | | 7/1991 | Rottmann | |
| 5,235,816 A | | 8/1993 | Parsnick et al. | |
| 5,386,691 A | * | 2/1995 | Bonaquist et al. | 62/646 |
| 5,419,136 A | * | 5/1995 | McKeigue | 62/645 |
| 2003/0101745 A1 | * | 6/2003 | O'Connor | 62/646 |
| 2007/0095100 A1 | * | 5/2007 | Rankin et al. | 62/643 |
| 2007/0209388 A1 | * | 9/2007 | Weber et al. | 62/643 |

FOREIGN PATENT DOCUMENTS

FR 2831250 4/2003

OTHER PUBLICATIONS

RMP Lecture notes by R.M. Price Apr. 14, 1998.*
Wallis, G., "One-dimensional Two-phase Flow", McGraw-Hill Book Company, 1969.
Vijayan, M. et al., "Effect of Tube Diameter on Flooding", Int'l Journal of Multiphase Flow 27, 2001, pp. 797-816.

* cited by examiner

*Primary Examiner* — Mohammad M Ali
*Assistant Examiner* — Keith Raymond
(74) *Attorney, Agent, or Firm* — David M. Rosenblum

(57) ABSTRACT

The present invention provides a method of rectifying an oxygen, nitrogen and argon containing feed stream that employs high and low pressure columns and an argon column. Refrigeration is imparted through turboexpansion of a nitrogen-rich vapor stream withdrawn from the high pressure column. The nitrogen-rich vapor stream has a sufficiently high flow rate that the flow of both vapor and liquid within the low pressure column is decreased to such an extent that the diameter of the low pressure column can be made substantially equal to or less than that of the high pressure column. The use of the argon column allows recovery of the oxygen to be increased over that which would otherwise be obtained given the draw of the nitrogen-rich vapor. The argon column can be an argon rejection column in which the separated argon is discarded as waste.

11 Claims, 1 Drawing Sheet

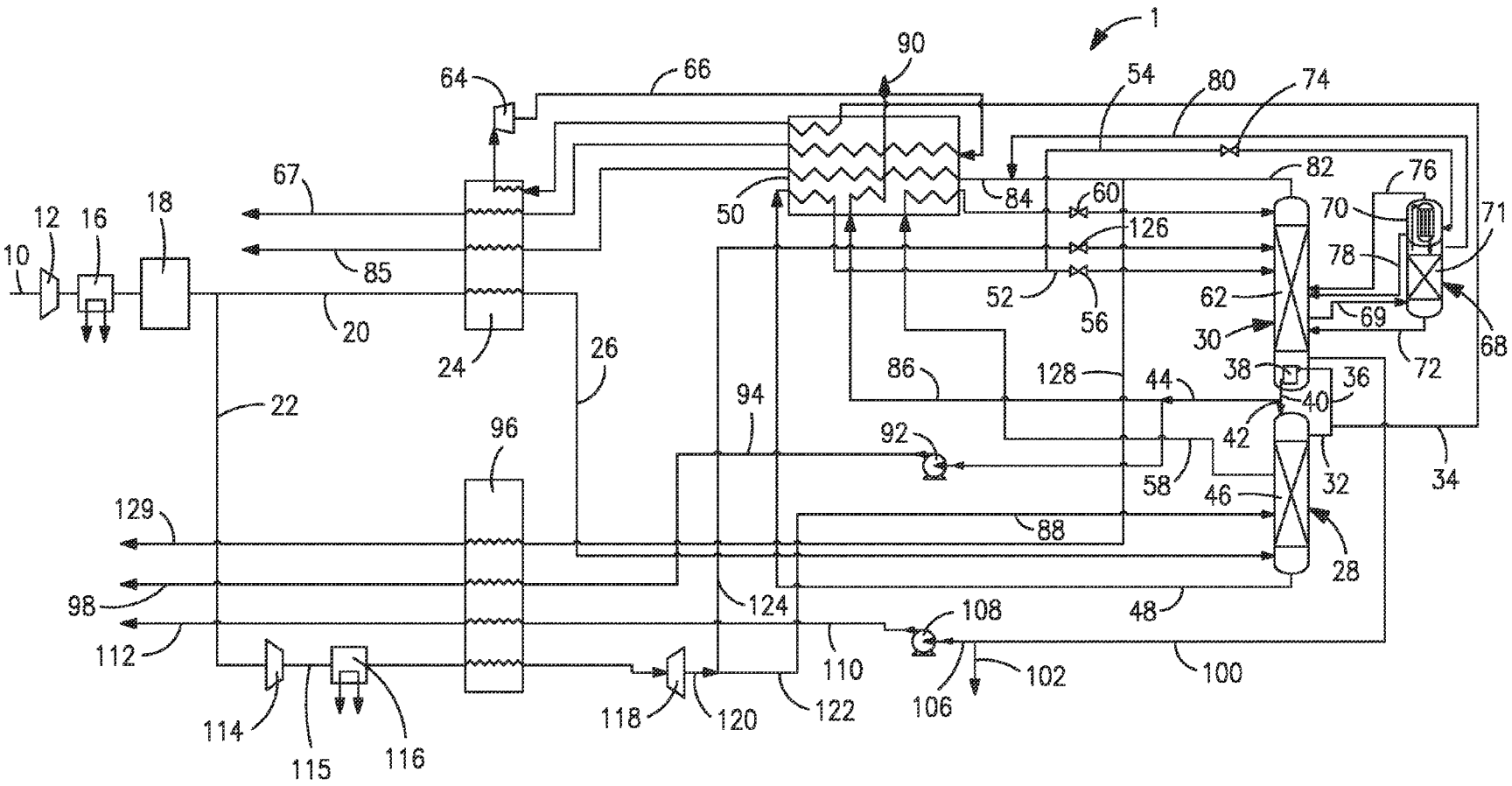
1
10
12
16
18
20
22
24
26
28
30
32
34
36
38
40
42
44
46
48
50
52
54
56
58
60
62
64
66
67
68
69
70
71
72
74
76
78
80
82
84
85
86
88
90
92
94
96
98
100
102
106
108
110
112
114
115
116
118
120
122
124
126
128
129

CRYOGENIC RECTIFICATION METHOD

FIELD OF THE INVENTION

The present invention relates to a method of rectifying an oxygen, nitrogen and argon containing mixture in a cryogenic rectification process utilizing a high pressure column, a low pressure column and an argon column. More particularly, the present invention relates to such a method in which the flow rate of nitrogen-rich vapor produced in a high pressure column is selected to reduce the vaporization of an oxygen-rich liquid column bottoms produced in the low pressure column and thereby to permit the diameter of the low pressure column to be sized substantially equal to or less than that of the high pressure column.

BACKGROUND OF THE INVENTION

Air is rectified into oxygen, nitrogen and argon component by a process known as cryogenic rectification. In such a process the air, or other gas containing oxygen, nitrogen and argon, is compressed, purified of higher boiling contaminants such as water vapor, carbon dioxide and hydrocarbons. At least part of the compressed and purified air is cooled to a temperature suitable for its rectification within a main heat exchanger. The cooled air is thereafter introduced into a double distillation column arrangement having a high pressure column thermally linked to a low pressure column to separate the nitrogen from the oxygen. An argon column can be connected to the low pressure column to receive an argon containing vapor stream from the low pressure column and to separate the argon from the oxygen. The separation produces an argon-rich stream as column overhead of the argon column.

The high and low pressure columns are thermally linked so that a nitrogen-rich vapor produced in the high pressure column is liquefied against a vaporizing oxygen-rich liquid column bottoms of the low pressure column. The nitrogen-rich liquid is used, at least in part, to reflux the high pressure column and also the low pressure column to initiate descending liquid phases within such columns. The descending liquid phases contact ascending vapor phases in mass transfer contacting elements such as sieve trays or structured packing so that the vapor phases become evermore rich in nitrogen as they ascend the columns and the liquid phases become evermore rich in oxygen as they descend within the columns. The ascending vapor phase in the low pressure column is produced by the vaporization of the oxygen-rich liquid and the ascending vapor phase in the high pressure column is produced from the incoming air. In the high pressure column an oxygen enriched liquid is produced that is known as kettle liquid. At least a portion of the kettle liquid is used to condense argon reflux in the argon column and then introduced into the low pressure column for further refinement. Oxygen and nitrogen-rich streams can be taken as products that are warmed in the main heat exchanger and help to cool the incoming air.

Since there exists heat leakage into such process and warm end losses in the main heat exchanger, refrigeration is imparted to the process. This is done by expanding some of the incoming air in a turboexpander or some of the nitrogen-rich vapor and introducing the resulting exhaust into the main heat exchanger. Typically, the nitrogen-rich vapor is extracted from the low pressure column. When air is used to generate refrigeration, the air separation plant is often referred to as an air expansion plant and when nitrogen is used from the low pressure column the plant can be termed as a nitrogen expansion plant. However, there have been air separation plants in which the nitrogen-rich vapor is expanded from the high pressure column.

Although in many schematic representations of air separation plants appearing in the open literature or in published patents and applications, the low pressure column appears to be the same diameter as the high pressure column. This is rarely if ever the case in practice. The reason for this is that the volumetric flow of vapor in the low pressure column is typically much higher than in the high pressure column due to its lower pressure. As the column diameter is reduced, the superficial velocities of the vapor and the liquid will increase due to the fact that volume flow is a function of a product of velocity and cross-sectional flow area. However, for a given reflux rate of liquid, there exists a limitation on the superficial vapor velocity produced by ascending vapor of the vapor phase at which the vapor resists the downflowing liquid progress in the column in a condition known as flooding. Thus, for a given reflux rate, the superficial vapor velocity must be less than the velocity that would otherwise produce flooding of the column. In order to manage the velocity in the low pressure column, the low pressure column requires a larger diameter than the high pressure column to decrease velocities in the low pressure column that would otherwise occur with the higher volumetric flow rates. In this regard, the superficial vapor velocity is not constant within the low pressure column and will vary in sections or regions thereof in which there are vapor feeds. However, there exists a maximum superficial velocity and the low pressure column diameter will be designed to accommodate the maximum without flooding in a manner very well known in the art.

The problem with having a low pressure column with a larger diameter than the high pressure column is that shipment costs of the column system from the fabricator to the site at which the plant will be erected are increased. The shipping girths can be such that shipping is impractical or cost prohibitive, and local fabrication becomes necessary. This is often not desirable as a result of high local labor rates and less controllable conditions. This being said, there is some degree of choice in the design of the low pressure column with respect to its diameter. For example, in a column using structured packing, in regions of the column at which there exists high superficial vapor velocities, a lower density packing can be used to reduce the diameter of the column. The problem with this is that the efficiency of the packing is reduced or in other words, the packing operates at a higher HETP resulting in the height of the column increasing. The increase in height also results in increased shipping and fabrication costs in that in such case the column is split into sections that are separately shipped.

As will be discussed, among other advantages, the present invention provides a method of conducting a cryogenic rectification process that incorporates a low pressure column that has substantially the same diameter, or even a lower diameter than the high pressure column. Moreover, this reduction in size effectuated without or with a minimum increase in height. The cryogenic equipment, including the distillation columns, heat exchangers, turboexpanders, with associated piping and valves is housed in a container called a cold box. A space is maintained between the cryogenic equipment and the cold box, and the cold box is internally insulated, often with dumped material such as perlite. The size of the cryogenic equipment directly affects the design of the cold box, its size, and is also important in project economics and time length related to the preceding shipping and fabrication discussion.

SUMMARY OF THE INVENTION

The present invention provides a method of rectifying a feed stream containing oxygen, nitrogen and argon. In accordance with the method, the feed stream is rectified in a cryogenic rectification process employing a high pressure column operatively associated with a low pressure column in a heat transfer relationship to condense a nitrogen-rich vapor formed in the high pressure column through indirect heat exchange with an oxygen-rich liquid column bottoms formed in the low pressure column. An argon column is connected to the low pressure column to separate the argon from the oxygen.

The high pressure column and the low pressure column are each configured to separate the nitrogen from the oxygen by contacting an ascending vapor phase becoming evermore rich in nitrogen as it ascends with a descending liquid phase becoming evermore rich in oxygen as it descends. The ascending vapor phase is contacted with the descending liquid phase, in each of the high pressure column and the low pressure column, within mass transfer contacting elements peripherally bounded by a column diameter selected such that a maximum superficial vapor velocity produced by the ascending vapor phase results in a vapor capacity factor below an operational limit at which flooding would otherwise occur within the mass transfer contacting elements in which the maximum superficial vapor velocity occurs. The column diameter of the low pressure column is substantially equal to or less than the diameter of the high pressure column. It is to be noted that as used herein and in the claims, the term, "superficial vapor velocity" means a vapor velocity that is determined by dividing the volume flow of the vapor by a flow area defined as if there were no mass transfer media such as structured packing or trays. The term, "vapor capacity factor" as used herein and in the claims means a product of the superficial vapor velocity and the square root of the vapor density divided by a difference between the liquid density and the vapor density multiplied by the gravitational constant and the column diameter. The argon column is connected to the low pressure column such that the argon is separated from the oxygen contained in an argon and oxygen containing vapor stream is withdrawn from the low pressure column and an oxygen-rich liquid stream resulting from the separation of the argon from the oxygen is returned to the low pressure column. The presence of the argon column and the removal of the argon from the low pressure column increases the recovery of oxygen within the oxygen-rich liquid column bottoms that would otherwise be lost due to the turboexpansion of the nitrogen-rich vapor stream.

Refrigeration to the cryogenic rectification process is imparted with an exhaust stream produced by expanding a nitrogen-rich vapor stream composed of the nitrogen-rich vapor of the high pressure column within a turboexpander also employed within the air separation process. The nitrogen-rich vapor stream has a vapor flow rate such that vaporization of the oxygen-rich liquid column bottoms produces the maximum superficial vapor velocity that results in the vapor capacity factor within the low pressure column that is below the operational limit at which the flooding would have otherwise occurred within the mass transfer contacting elements in which the maximum superficial vapor velocity occurs. An oxygen product is produced from an oxygen-rich stream that is withdrawn from the low pressure column. The oxygen-rich stream is composed of the oxygen-rich liquid column bottoms.

The separation of the argon from the oxygen contained in the argon and oxygen containing vapor stream produces an argon containing column overhead within the argon column. An argon containing stream composed of part of the argon containing column overhead can be discharged from the cryogenic rectification process and is not recovered. The feed stream is compressed and purified to produce a compressed and purified feed stream. A high pressure column feed stream is formed from at least part of the compressed and purified feed stream. The high pressure column feed stream is cooled and introduced into the high pressure column. The refrigeration is imparted into the cryogenic rectification process by indirectly exchanging heat from the exhaust stream with at least the high pressure column feed stream during the cooling thereof. The high pressure column feed stream can be formed from part of the compressed and purified feed stream. A further compressed feed stream is formed by further compressing another part of the compressed and purified feed stream. The oxygen product can then be formed by pumping at least part of the oxygen-rich stream to produce a pressurized oxygen-rich stream and warming the pressurized oxygen-rich stream to ambient temperature through indirect heat exchange with the further compressed feed stream, thereby to cool the further compressed feed stream. The further compressed feed stream, after having been cooled, is reduced in pressure and introduced into at least one of the high pressure column and the low pressure column as a liquid stream, predominantly containing liquid.

The high pressure column reflux stream serving as high pressure column reflux to the high pressure column can be formed from part of a nitrogen-rich liquid stream produced from the condensation of the nitrogen-rich vapor. Another part of the nitrogen-rich liquid stream can be pumped to form a pressurized nitrogen-rich liquid stream. The pressurized nitrogen-rich liquid stream can be warmed to the ambient temperature also through indirect heat exchange with the further compressed feed stream, thereby to form a nitrogen product.

In any embodiment of the present invention involving a pumped or pressurized product, the high pressure column feed stream can be cooled within a first heat exchanger. The indirect heat exchange between the pressurized oxygen-rich stream and the further compressed feed stream can take place within a second heat exchanger. In such case, the refrigeration can be imparted into the air separation process by warming the exhaust stream within the first heat exchanger. A kettle liquid stream composed of a crude liquid oxygen column bottoms formed in the high pressure column can be divided into first subsidiary kettle liquid stream and a second subsidiary kettle liquid stream. The first subsidiary kettle liquid stream is reduced in pressure and introduced into an intermediate location of the low pressure column for further refinement. The second subsidiary kettle liquid stream is reduced in pressure and utilized to at least partially condense another part of the argon containing column overhead to produce an argon containing reflux for the argon column and an oxygen containing vapor phase and an oxygen containing liquid phase formed by partial vaporization of the second kettle liquid stream. Vapor and liquid phase streams composed of the oxygen containing vapor phase and the oxygen containing liquid phase, respectively, are introduced into the low pressure column. The kettle liquid stream and a low pressure column reflux stream that serve as the reflux to the low pressure column are subcooled within a subcooling unit through indirect heat exchange with at least part of a nitrogen containing column overhead stream composed of a low pressure nitrogen containing column overhead produced in the low pressure column, the nitrogen-rich vapor stream and the exhaust stream. The nitrogen-rich vapor stream after passage through the subcooling unit is partially warmed in the first heat exchanger and then passed into the turboexpander and the exhaust stream, after passage through the subcooling unit, is introduced into the first heat exchanger.

The low pressure column reflux stream can be withdrawn from a level of the high pressure column such that the low pressure column reflux stream has a lower nitrogen purity than the high pressure column reflux stream. Part of the low pressure nitrogen containing column overhead stream is introduced into the subcooling unit and a remaining part of the low pressure nitrogen containing column overhead stream is warmed within the second heat exchanger to thermally balance the second heat exchanger.

The separation of the argon from the oxygen contained in the argon and oxygen containing vapor stream produces an argon containing column overhead and an argon containing stream composed of part of the argon containing column overhead is combined with the nitrogen-containing column overhead stream prior to the introduction of the nitrogen-containing column overhead stream into the subcooling unit. The liquid stream can be reduced in pressure within a liquid expander to produce further refrigeration. A yet other part of the nitrogen-rich liquid stream can be subcooled within the subcooling unit and taken as a liquid nitrogen product.

BRIEF DESCRIPTION OF THE DRAWING

While the specification concludes with claims distinctly pointing out the subject matter that Applicants regard as their invention, it is believed that the invention will be better understood when taken in connection with the accompanying sole FIGURE that is a schematic process flow diagram of an apparatus used in carrying out a method in accordance with the present invention.

DETAILED DESCRIPTION

With reference to the FIGURE, an air separation plant 1 is illustrated for carrying out a method in accordance with the present invention for rectifying a feed stream 10 that contains oxygen, nitrogen and argon. Feed stream 10 can be air or other air derived stream that is obtained from some other process. It is understood that air separation plant 1 is described herein for exemplary purposes.

The feed stream 10 is compressed by a compressor 12 and after removing the heat of compression within an aftercooler 16, the compressed feed stream 10 is purified within a purification unit 18 having beds of adsorbent to remove higher boiling impurities such as water vapor, carbon dioxide and hydrocarbons. The resulting compressed and purified feed stream 10 is then divided into a first part 20 and a second part 22.

The first part 20 is cooled within a first heat exchanger 24 and then fully cooled to a temperature suitable for its rectification. The resulting cooled stream 26 is introduced into a high pressure column 28 of a double column unit also having a low pressure column 30. High pressure column 28 operates at a pressure of between about 60 psia and about 100 psia and is so named to distinguish it from the low pressure column 30 that operates at a low pressure, for instance between about 15 psia and about 25 psia. The introduction of cooled stream 26 initiates formation of an ascending vapor phase that becomes ever richer in nitrogen to produce a nitrogen-rich vapor column overhead within the high pressure column 28. A stream of the high pressure column nitrogen-rich vapor column overhead, designated by reference number 32 is withdrawn from the high pressure column 28 and divided into first and second subsidiary nitrogen-rich vapor streams 34 and 36. Second subsidiary nitrogen-rich vapor stream 36 is introduced into a condenser reboiler 38 located in the bottom of low pressure column 30 and is condensed against vaporizing an oxygen-rich liquid column bottoms that accumulated in the bottom of low pressure column 30. The condensation produces a nitrogen-rich liquid stream that is divided into a reflux stream 42 and a high pressure liquid nitrogen product stream 44. Reflux 42 is introduced into the top of high pressure column 28 to initiate formation of a descending liquid phase. Contact between the ascending vapor phase and the descending liquid phase is carried out within mass transfer contacting elements 46 located within the high pressure column 28. These mass transfer elements can be trays or structured packing. As a result of such contact, the descending liquid phase becomes ever richer in oxygen to form a crude liquid oxygen column bottoms in the high pressure column 28.

A kettle liquid stream 48 composed of the crude liquid oxygen column bottoms is subcooled within a subcooling unit 50 and divided into first and second kettle liquid streams 52 and 54. First kettle liquid stream 52 is reduced in pressure by an expansion valve 56 and then introduced into the low pressure column 30 for further refinement by rectification in such column. The oxygen-rich liquid column bottoms of the low pressure column 30 is in part vaporized by condenser reboiler 38 to initiate formation of the ascending vapor phase that becomes ever more rich in nitrogen as it ascends. The descending liquid phase is initiated by subcooling a reflux stream 58 that is withdrawn from the high pressure column, subcooled within subcooling unit 50, reduced in pressure by an expansion valve 60 and then, introduced into the top of low pressure column 30. It is to be noted that reflux stream 58 has a lower nitrogen content than nitrogen-rich liquid stream 40 due to the fact that the process is not designed to produce a low pressure, high purity nitrogen product from low pressure column 30. However, a reflux stream for low pressure column 30 could in fact be formed from part of the nitrogen-rich liquid stream. The descending liquid phase contacts the ascending vapor phase within the low pressure column 30 to produce the oxygen-rich liquid column bottoms discussed above and a nitrogen containing column overhead having a similar concentration as the reflux stream 58. The contact is produced by mass transfer contacting elements 62 provided within low pressure column 30 for such purposes.

Each of the high pressure column 28 and the low pressure column 30 has a column diameter that bounds the mass transfer contacting elements 46 and 62. This column diameter is selected so that for a superficial vapor velocity of vapor produced by the ascending vapor phase and a given flow rate of the reflux liquid, flooding within the particular mass transfer contacting elements will be avoided. During flooding, the ascending vapor produces a pressure drop through the mass transfer media of such magnitude that the downflowing liquid is impeded. The resulting build up of liquid eventually floods the column and the intended mass transfer ceases. The column diameter is normally not sized at the flooding point but below such point, typically 80 percent of column flooding. In accordance with the present invention, the low pressure column 62 is provided with a diameter that is substantially equal to or less than the high pressure column 28 and yet flooding is avoided by selecting an appropriate flow rate for first subsidiary nitrogen-rich vapor stream 34. As the flow rate of first subsidiary nitrogen-rich vapor stream 34 is increased, there will be less nitrogen available to boil the oxygen-rich liquid column bottoms of low pressure column 30. As such, the flow rate of reflux stream 58 will be reduced. The smaller diameter of low pressure column 30, however, allows for the superficial velocity of vapor produced by the ascending vapor phase for the given flow rate of the reflux liquid to be maintained at an approach to flooding condition.

More specifically, superficial velocity of up flowing vapor and down flowing liquid is the basis of distillation column design. The superficial velocity for both the vapor and liquid are defined as its volume flow (Q) divided by the flow area ($A_F$). The flow area is defined as if there is no mass transfer media (i.e. it is not reduced by the cross-sectional area of the structured packing or trays). For the vapor, superficial vapor velocity:

$$U_V = \frac{Q_V}{A_F}$$

Likewise, for the liquid, superficial liquid velocity:

$$U_L = \frac{Q_L}{A_F}$$

To define the flooding point of a distillation column, a correction to the superficial velocities for vapor and liquid density is added and the terms are made dimensionless. For the vapor, the dimensionless capacity factor:

$$U_V^* = U_V\sqrt{\frac{\rho_V}{gD(\rho_L - \rho_V)}}$$

For the liquid, the dimensionless capacity factor:

$$U_L^* = U_L\sqrt{\frac{\rho_L}{gD(\rho_L - \rho_V)}}$$

In the above equations, $\rho_v$ is the vapor density; $\rho_L$ is the liquid density; "g" is the gravitational constant; and "D" is the column diameter.

A treatment of flooding is given by G. F. Hewitt and G. B. Wallis, "Flooding and associated phenomena in falling film flow in a vertical tube," UKAEA Report, AERE R-4022, 1963, and G. B. Wallis, "One-dimensional Two-phase Flow," McGraw-Hill Book Company, 1969, Chapter 11, Annular Flow. As indicated in this treatise, for a certain flooding liquid capacity factor, there is a corresponding flooding vapor capacity factor for a distillation column containing a given mass transfer media. The square root of the flooding vapor capacity factor and the square root of the flooding liquid capacity factor can be related as a straight line, with a negative slope, according to the equation:

$$\sqrt{U^*_v} + \sqrt{U^*_L} = B$$

In the above equation, "A" and "B" are empirically determined constants, and "A" is negative. A plot that shows the relationship between the flooding vapor capacity factor and the flooding liquid capacity factor in this square root form is called a Wallis plot and the same is well known in the art. Typically, the vapor and liquid velocities are never allowed to reach their respective flooding values and as such, the column diameter is selected such that the vapor capacity factor is about 80 percent of the flooding capacity factor. The procedure for choosing the column diameter is then, to determine the flooding vapor capacity factor corresponding to the flooding liquid capacity factor from the Wallis plot for the selected mass transfer media and at a location at which the superficial vapor velocity is at a maximum. The column size is chosen such that $U_v$* is about 80 percent of the flooding $U_v$*. It becomes an iterative calculation to determine the column diameter with the Wallis plot.

Thus, in accordance with the present invention, given that the column diameter of low pressure column 30 is to be substantially equal to, if not less than, the diameter of the high pressure column 28, the flow rate of the nitrogen-rich vapor stream 34 is selected, for a given column diameter of the low pressure column 30 to produce a maximum superficial vapor velocity that will in turn result in a vapor capacity factor that will be less than the operational limit, or in other words, the flooding $U_v$* at which the low pressure column 30 would otherwise flood. In the illustrated embodiment the location at which the maximum superficial vapor velocity would occur would be above a point at which vapor phase stream 76, to be discussed, is introduced into low pressure column 30. The other regions of the columns would have a lower superficial vapor velocity and therefore, they would not limit the column diameter. The advantage of this is that in case of a low pressure column using structured packing, the density could be greater than otherwise could have been used in, for example, an air expansion cycle, and as result, the height of the low pressure column could be reduced. On the other hand, where both high and low pressure columns use trays, the invention could be used to reduce the diameter of the low pressure column to be about equal to or less than the high column, but without taking advantage of a height reduction. In a distillation column system in which the high pressure column used trays and the low pressure column used packing, the low pressure column would normally be of similar or larger diameter than the high pressure column. In such case, however, the present invention could be used to reduce the diameter of the low pressure column such that it is less than that of the high pressure column or to limit the superficial vapor velocities in the low pressure column and thereby allow higher density packings to be used with a reduction in the height of the low pressure column.

As would be apparent to anyone skilled in the art, the flow rate of the first subsidiary nitrogen-rich vapor stream 34 is set by the design and the operating conditions of air separation plant 1. For example, the incoming air flow rate, the size of piping leading to turboexpander 64, to be discussed, and the setting of control nozzles within turboexpander 64 will all act in concert to set the flow rate of the first subsidiary nitrogen-rich vapor stream 34.

First subsidiary nitrogen-rich vapor stream 34 is partly warmed within subcooling unit 50 and is further partly warmed within first heat exchanger 24. Thereafter, first subsidiary nitrogen-rich vapor stream 34 is introduced into a turboexpander 64 to produce an exhaust stream 66 to impart refrigeration to the process by recirculating exhaust stream 66 through subcooling unit 50 and then fully warming such stream within first heat exchanger 24 to produce a low pressure nitrogen stream 67 that can be taken as a product. However, if this is not necessary, stream 67 could be combined with nitrogen containing column overhead stream 82 to be discussed hereinafter. In this regard, first subsidiary nitrogen-rich vapor stream 34 could be withdrawn as a vapor several stages below the top of high pressure column 28 if it is not to be used as a product.

In order to increase oxygen recovery within low pressure column 30 an argon rejection column 68 is provided. Given the high rate of draw of first subsidiary nitrogen-rich vapor stream 34, if argon rejection column were not used, then the oxygen recovery would suffer in that a certain percentage of the oxygen would be lost in the waste nitrogen stream. In order to compensate for the loss, the air flow would have to be increased to provide practical and necessary production rates. This would require more power. Additionally, larger sizes would be needed for the columns as well as other unit operations and as such, the benefit of column diameter reduction would be lost. Argon rejection column 68, while being designed in the illustrated embodiment to rid low pressure column 30 of argon, could be designed to produce an argon product or a crude argon for further processing. In this regard, for purposes of comparison, argon rejection column would have between about 30 and about 50 stages of separation. If crude argon were to be produced for further processing, 50 stages would be used and if the argon were to be configured to produce an argon product then 180 stages might be used.

Argon rejection column 68 receives an argon and oxygen containing vapor stream 69 removed from low pressure column 30 to produce an argon containing overhead that is partly condensed by a condenser 70 to reflux argon rejection column 68. The reflux initiates formation of a descending liquid phase that contacts an ascending vapor phase initiated by introduction of argon and oxygen containing vapor stream 69. The phases are contacted within mass transfer contacting elements 71 that could again be trays or packing and preferably structured packing. The resulting separation produces an oxygen-rich liquid stream 72 that that is returned to low pressure column 30.

The column overhead of argon rejection column 68 is condensed by partially vaporizing second kettle liquid stream 54 after such stream has been reduced in pressure by an expansion valve 74. Vapor and liquid phase streams 76 and 78, respectively, produced by such partial vaporization are introduced into the low pressure column 30. An argon containing column overhead stream 80 is combined with a nitrogen containing column overhead stream 82 withdrawn from low pressure column 30 and the resulting combined stream 84 is partly warmed within subcooling unit 50 and then fully warmed within first heat exchanger 24. As such, the separated argon is not recovered and is simply discharged from the air separation plant 1 as a waste stream 85. It is to be noted that a nitrogen product, if required at a pressure of the low pressure column 30, could be taken as a product. In such case, reflux stream 58 would be formed from the same liquid forming high pressure liquid nitrogen stream 44 and waste nitrogen would be withdrawn several stages below the top of low pressure column 30 for purity control.

High pressure liquid nitrogen stream 44, discussed above, is divided into first and second nitrogen liquid streams 86 and 88. First nitrogen liquid stream 86 is subcooled within subcooling unit 50 and taken as a liquid nitrogen product stream 90. This, however is optional. Second nitrogen liquid stream 88 is pumped by a pump 92 to form a pressurized liquid nitrogen stream 94. Pressurized liquid nitrogen stream 94 is fully warmed within a second heat exchanger 96 to produce a high pressure nitrogen vapor product stream 98.

An oxygen-rich liquid stream 100 that is composed of the oxygen-rich liquid column bottoms of low pressure column 30 is removed from low pressure column 30. A part 102 of oxygen-rich liquid stream 100 can optionally be taken as a liquid oxygen product stream. A remaining part 106 of oxygen-rich liquid stream 100 can be pumped in a pump 108 to produce a pressurized liquid oxygen stream 110 that is fully warmed within second heat exchanger 96 and taken as a high pressure oxygen product stream 112.

In order to warm the pressurized liquid nitrogen stream 94 and the remaining part 106 of oxygen-rich liquid stream 100, the second part 22 of compressed and purified stream 10 can be compressed in a booster compressor 114 to produce a further compressed stream 115. After removal of the heat of compression by an aftercooler 116, the further compressed stream 115 is cooled within second heat exchanger 96 and expanded in a turboexpander 118 substantially to the pressure of the high pressure column 28 and thereby produce a liquid stream 120. The turboexpansion produces additional refrigeration. Liquid stream 120 is divided into subsidiary liquid streams 122 and 124. Subsidiary liquid stream 122 is introduced into the high pressure column 28 and subsidiary liquid stream 124 is reduced in pressure by an expansion valve 126 and introduced into low pressure column 30. A nitrogen balance stream 128 composed of part of the nitrogen containing column overhead stream 82 can be introduced into second heat exchanger 96 to ensure that the cold end temperature of second heat exchanger 96 is at least close to that of first heat exchanger 24 and then discharged as a secondary waste stream 129. This, however is optional in that it is possible to contact all of the main heat exchange required within a single heat exchanger.

The following calculated example of the operation of air separation plant 1 is set forth in the Table below:

EXAMPLE STREAM SUMMARY

| STREAM | Flow, mol/hr | Pressure psia | Temperature, K | % vapor | Molar composition N2 frac | Ar frac | O2 frac |
|---|---|---|---|---|---|---|---|
| 115[1] | 288.0 | 1600 | 299.8 | 100 | 0.7811 | 0.0093 | 0.2095 |
| 115[2] | 288.0 | 1600 | 103.7 | 0 | 0.7811 | 0.0093 | 0.2095 |
| 122 | 187.2 | 84.0 | 98.1 | 3.3 | 0.7811 | 0.0093 | 0.2095 |
| 124 | 100.8 | 84.0 | 98.1 | 3.3 | 0.7811 | 0.0093 | 0.2095 |
| 20 | 712.0 | 83.0 | 283.2 | 100 | 0.7811 | 0.0093 | 0.2095 |
| 26 | 712.0 | 79.0 | 103.7 | 100 | 0.7811 | 0.0093 | 0.2095 |
| 48 | 463.7 | 79.0 | 99.5 | 0 | 0.5907 | 0.0150 | 0.3943 |
| 58 | 217.5 | 78.6 | 95.3 | 0 | 0.9675 | 0.0065 | 0.0261 |
| 86 | 1.6 | 78.3 | 95.0 | 0 | 1.0000 | 0.000014 | 0.000003 |
| 88 | 19.8 | 78.3 | 95.0 | 0 | 1.0000 | 0.000014 | 0.000003 |
| 34 | 196.6 | 78.3 | 95.0 | 100 | 1.0000 | 0.000014 | 0.000003 |
| 52 | 194.7 | 79.0 | 91.2 | 0 | 0.5907 | 0.0150 | 0.3943 |
| 54 | 268.9 | 79.0 | 91.2 | 0 | 0.5907 | 0.0150 | 0.3943 |
| 76 | 254.9 | 22.0 | 88.0 | 100 | 0.6068 | 0.0149 | 0.3784 |
| 78 | 14.0 | 22.0 | 88.0 | 0 | 0.3001 | 0.0177 | 0.6822 |

-continued

EXAMPLE STREAM SUMMARY

| STREAM | Flow, mol/hr | Pressure psia | Temperature, K | % vapor | Molar composition N2 frac | Ar frac | O2 frac |
|---|---|---|---|---|---|---|---|
| 69 | 220.4 | 20.0 | 93.0 | 100 | 0.0021 | 0.0651 | 0.9328 |
| 72 | 215.0 | 20.0 | 93.0 | 0 | 0.0006 | 0.0443 | 0.9551 |
| 58 | 217.5 | 78.6 | 81.7 | 0 | 0.9675 | 0.0065 | 0.0261 |
| 90 | 1.6 | 78.3 | 81.7 | 0 | 1.0000 | 0.000014 | 0.000003 |
| 80 | 5.4 | 19.8 | 89.8 | 100 | 0.0636 | 0.8914 | 0.0450 |
| 100 | 203.9 | 20.3 | 93.4 | 0 | 0.0000 | 0.0040 | 0.9960 |
| 102 | 5.4 | 20.3 | 93.4 | 0 | 0.0000 | 0.0040 | 0.9960 |
| 110 | 198.5 | 1221 | 97.4 | 0 | 0.0000 | 0.0040 | 0.9960 |
| 112 | 198.5 | 1218 | 291.5 | 100 | 0.0000 | 0.0040 | 0.9960 |
| 94 | 19.8 | 168.0 | 95.7 | 0 | 1.0000 | 0.000014 | 0.000003 |
| 98 | 19.8 | 162.0 | 291.5 | 100 | 1.0000 | 0.000014 | 0.000003 |
| 82 | 572.7 | 19.5 | 80.2 | 100 | 0.9826 | 0.0064 | 0.0110 |
| 128 | 68.1 | 19.5 | 80.2 | 100 | 0.9826 | 0.0064 | 0.0110 |
| 129 | 68.1 | 15.7 | 291.5 | 100 | 0.9826 | 0.0064 | 0.0110 |
| 84 | 509.9 | 19.3 | 98.0 | 100 | 0.9729 | 0.0158 | 0.0113 |
| 85 | 509.9 | 17.2 | 279.1 | 100 | 0.9729 | 0.0158 | 0.0113 |
| 34 | 196.6 | 77.3 | 114.0 | 100 | 1.0000 | 0.000014 | 0.000003 |
| 66 | 196.6 | 19.5 | 79.9 | 100 | 1.0000 | 0.000014 | 0.000003 |
| 66 | 196.6 | 19.3 | 98.0 | 100 | 1.0000 | 0.000014 | 0.000003 |
| 67 | 196.6 | 17.2 | 279.1 | 100 | 1.0000 | 0.000014 | 0.000003 |

Note 1, stream 115, indicates the stream properties after the after cooler 116 but before the second heat exchanger 96 and Note 2 indicates the stream properties with respect to stream 115 after the second heat exchanger 96.

Air separation plant 1, operated in accordance with the above example could utilize high and low pressure columns 28 and 30 in which the diameter of the low pressure column 28 was less than that of the high pressure column 30. Both columns utilized structured packing and the density of the packing at vapor limiting sections of the columns at which maximum superficial vapor velocities were produced were the same in both columns. At locations that had less than the maximum superficial vapor velocity, higher density packings could be used to shorten the length of the columns.

Having described a preferred embodiment of the present invention, there are certain modifications that could be made beyond those discussed above. For example, although high pressure nitrogen product stream 98 and high pressure oxygen product stream 112 are produced, embodiments of the present invention are possible in which only one or such high pressure product streams are produced or only one of such streams is produced at a lower pressure without pumping. For example, oxygen-rich liquid stream could in part or entirely be taken as an oxygen product at lower pressure without pumping to a higher pressure. The use of first and second heat exchangers 24 and 96 in a "banked" design in which second heat exchanger 96 is a high pressure heat exchanger is principally a cost consideration in that higher pressure heat exchangers are more expensive to fabricate than lower pressure heat exchangers. Thus, a single "integrated" heat exchanger could be used at a higher expense. In this regard, often the subcooling unit is combined with the main heat exchanger. This is applied by combining subcooling unit 50 with first heat exchanger 24. Based on an "integrated" rather than a "banked" design, subcooling unit 50 is combined with the integrated main heat exchanger, which is a combination of first heat exchanger 24 and second heat exchanger 96. It must be pointed out that heat exchangers 24, 96, and 20 in either the "banked" or combined designs are generally representative of multiple heat exchangers in parallel. For larger plants, practical sizing and manufacturing capabilities of heat exchangers require that identical multiple, parallel units are installed.

The withdrawal of the first subsidiary nitrogen-rich vapor stream 34 of the nitrogen-rich vapor for later expansion within turboexpander 64 at a rate that will allow a low pressure column to be constructed have a lower than normal diameter will generate excess refrigeration beyond the amount that would otherwise be generated at lower flow rates. The effect of this is to open up the temperature differences within the first and second heat exchangers 24 and 96 or another other type of heat exchange system to produce larger than usual warm end temperature differences. This can be taken advantage of by reducing the flow or pressure of stream 115 to in turn reduce the internal temperature approach of the cooling streams and the warming streams, known as the "pinch point" within second heat exchanger 96. Second heat exchanger 96 is designed, however, such that a greater amount of flow of the second part 22 of compressed and purified air stream 22 would result in the warming streams, for example, high pressure oxygen product stream 112 being able to be warmed to ambient. Thus, the lower flow rate of the second part 22 of compressed and purified stream 10 reduces the power requirements of air separation plant 1.

A further point worth mentioning with respect to heat exchange is that since the first subsidiary nitrogen-rich vapor stream 34 of the nitrogen-rich vapor is being withdrawn at a rate to allow the use of a lower column diameter for low pressure column 30, the heat exchange duty placed upon condenser reboiler 38 is reduced. As per the previous discussion regarding heat exchangers 24, 96, and 50, condenser reboiler 38 also consists of identical multiple, parallel units for larger plants. The reduced duty can be taken advantage of by reducing the number of parallel units, or the cross-section of each unit of condenser reboiler 38 that would otherwise be required without the excess flow rate of vapor stream 34. This would reduce the diameter of the container housing condenser reboiler 38, preferably to the same dimension as low pressure column 30. This is significant, because a larger vessel size could be very detrimental because it would directly impact the girth of the cold box, reducing the savings sought in shipping and fabrication of the plant. The height of condenser reboiler 38 could also be reduced as a result of the reduced duty, leading to a reduction in height of the cold box. This is usually of less value than reducing the girth.

A further modification that could possibly be made in the operation of air separation plant 1 concerns the expansion of the first subsidiary nitrogen-rich vapor stream 34. In the illustrated embodiment, first subsidiary nitrogen-rich vapor stream 34 is a saturated vapor upon removal from the high pressure column 28. Consequently, it is partly warmed before being turboexpanded within turboexpander 64. If such stream were not warmed and instead were expanded in its saturated state, the exhaust stream 66 of turboexpander 64 would be in a partly liquid state that could be as high as 10 percent by mass or mole. The advantage of this would be to allow the liquid to be employed in refluxing the low pressure column 30 to reduce the overall power requirements of air separation plant 1. The disadvantage would be that the liquid could form in the turbine. If such liquid formed before or within the turbine impeller, erosion and/or reliability problems would result.

While the present invention has been described with reference to a preferred embodiment, as will occur to those skilled in the art, numerous additions, changes and omissions can be made without departing from the spirit and scope of the invention as set forth in the appended claims.

We claim:

1. A method of rectifying a feed stream containing oxygen, nitrogen and argon comprising:

rectifying the feed stream in a cryogenic rectification process employing a high pressure column operatively associated with a low pressure column in a heat transfer relationship to condense a nitrogen-rich vapor formed in the high pressure column through indirect heat exchange with an oxygen-rich liquid column bottoms formed in the low pressure column and an argon column connected to the low pressure column to separate the argon from the oxygen;

the high pressure column and the low pressure column each being configured to separate the nitrogen from the oxygen by contacting an ascending vapor phase becoming evermore rich in nitrogen as the ascending vapor phase ascends with a descending liquid phase becoming evermore rich in oxygen as it descends, the ascending vapor phase being contacted with the descending liquid phase, in each of the high pressure column and the low pressure column, within mass transfer contacting elements peripherally bounded by a column diameter selected such that a maximum superficial vapor velocity produced by the ascending vapor phase results in a vapor capacity factor below an operational limit at which flooding would otherwise occur within the mass transfer contacting elements in which the maximum superficial vapor velocity occurs and the column diameter of the low pressure column is substantially equal to or less than the diameter of the high pressure column;

the argon column being connected to the low pressure column such that the argon is separated from the oxygen contained in an argon and oxygen containing vapor stream that is withdrawn from the low pressure column and an oxygen-rich liquid stream resulting from the separation of the argon from the oxygen is returned to the low pressure column, thereby to increase recovery of oxygen within the oxygen-rich liquid column bottoms;

imparting refrigeration to the cryogenic rectification process with an exhaust stream produced by expanding a nitrogen-rich vapor stream composed of the nitrogen-rich vapor of the high pressure column within a turboexpander also employed within the air separation process;

the nitrogen-rich vapor stream having a vapor flow rate such that vaporization of the oxygen-rich liquid column bottoms produces the maximum superficial vapor velocity within the low pressure column that is below the operational limit at which the flooding would have otherwise occurred within the mass transfer contacting elements in which the maximum superficial vapor velocity occurs; and forming an oxygen product from an oxygen-rich stream withdrawn from the low pressure column and composed of the oxygen-rich liquid column bottoms.

2. The method of claim 1, wherein the separation of the argon from the oxygen contained in the argon and oxygen containing vapor stream produces an argon containing column overhead and an argon containing stream composed of part of the argon containing column overhead is discharged from the cryogenic rectification process and is not recovered.

3. The method of claim 1, wherein:

the feed stream is compressed and purified to produce a compressed and purified feed stream;

a high pressure column feed stream is formed from at least part of the compressed and purified feed stream;

the high pressure column feed stream is cooled and introduced into the high pressure column; and the refrigeration is imparted into the cryogenic rectification process by indirectly exchanging heat from the exhaust stream with at least the high pressure column feed stream during the cooling thereof.

4. The method of claim 3, wherein:

the high pressure column feed stream is formed from part of the compressed and purified feed stream;

a further compressed feed stream is formed by further compressing another part of the compressed and purified feed stream;

the oxygen product is formed by pumping at least part of the oxygen-rich stream to produce a pressurized oxygen-rich stream and warming the pressurized oxygen-rich stream to ambient temperature through indirect heat exchange with the further compressed feed stream, thereby to cool the further compressed feed stream; and the further compressed feed stream after having been cooled is reduced in pressure and introduced into at least one of the high pressure column and the low pressure column as a liquid stream, predominantly containing liquid.

5. The method of claim 4, wherein:

a high pressure column reflux stream serving as high pressure column reflux to the high pressure column is formed from part of a nitrogen-rich liquid stream produced from the condensation of the nitrogen-rich vapor;

another part of the nitrogen-rich liquid stream is pumped to form a pressurized nitrogen-rich liquid stream; and the pressurized nitrogen-rich liquid stream is warmed to the ambient temperature also through indirect heat exchange with the further compressed feed stream, thereby to form a nitrogen product.

6. The method of claim 3, wherein:

the high pressure column feed stream is cooled within a first heat exchanger;

the indirect heat exchange between the pressurized oxygen-rich stream and the further compressed feed stream takes place within a second heat exchanger; and the refrigeration is imparted into the air separation process by warming the exhaust stream within the first heat exchanger.

7. The method of claim 6, wherein:

a kettle liquid stream composed of a crude liquid oxygen column bottoms formed in the high pressure column is divided into first subsidiary kettle liquid stream and a second subsidiary kettle liquid stream;

the first subsidiary kettle liquid stream is reduced in pressure and introduced into an intermediate location of the low pressure column for further refinement;

the second subsidiary kettle liquid stream is reduced in pressure and utilized to at least partially condense another part of the argon containing column overhead to produce an argon containing reflux for the argon column and an oxygen containing vapor phase and an oxygen containing liquid phase formed by partial vaporization of the second kettle liquid stream;

vapor and liquid phase streams composed of the oxygen containing vapor phase and the oxygen containing liquid phase, respectively, are introduced into the low pressure column;

the kettle liquid stream and a low pressure column reflux stream serving as the reflux to the low pressure column are subcooled within a subcooling unit through indirect heat exchange with at least part of a nitrogen containing column overhead stream composed of a low pressure nitrogen containing column overhead produced in the low pressure column, the nitrogen-rich vapor stream and the exhaust stream;

the nitrogen-rich vapor stream after passage through the subcooling unit is partially warmed in the first heat exchanger and then passed into the turboexpander; and the exhaust stream after passage through the subcooling unit is introduced into the first heat exchanger.

8. The method of claim 7, wherein:

the low pressure column reflux stream is withdrawn from a level of the high pressure column such that the low pressure column reflux stream has a lower nitrogen purity than the high pressure column reflux stream; and part of the low pressure nitrogen containing column overhead stream is introduced into the subcooling unit and a remaining part of the low pressure nitrogen containing column overhead stream is warmed within the second heat exchanger to thermally balance the second heat exchanger.

9. The method of claim 7, wherein the separation of the argon from the oxygen contained in the argon and oxygen containing vapor stream produces an argon containing column overhead and an argon containing stream composed of part of the argon containing column overhead is combined with the nitrogen containing column overhead stream prior to the introduction of the nitrogen containing column overhead stream into the subcooling unit.

10. The method of claim 7, wherein the liquid stream is reduced in pressure within a liquid expander to produce further refrigeration.

11. The method of claim 7, wherein a yet other part of the nitrogen-rich liquid stream is subcooled within the subcooling unit and taken as a liquid nitrogen product.

* * * * *